252-102 AU 166 EX
9/15/81 XR 4,289,642

United States Patent [19]
Weber et al.
[11] 4,289,642
[45] Sep. 15, 1981

[54] DETERGENT COMPOSITION HAVING A SIZING EFFECT COMPRISING NONIONIC AND/OR ZWITTERIONIC TENSIDES AND POLYSACCHARIDE AMINO ESTERS

[75] Inventors: Rudolf Weber, Düsseldorf; Hans Andree, Leichlingen, both of Fed. Rep. of Germany

[73] Assignee: Henkel Kommanditgesellschaft auf Aktien, Düsseldorf-Holthausen, Fed. Rep. of Germany

[21] Appl. No.: 126,037

[22] Filed: Feb. 29, 1980

[30] Foreign Application Priority Data

Mar. 26, 1979 [DE] Fed. Rep. of Germany ..... 2911857

[51] Int. Cl.[3] ..... C11D 3/22

[52] U.S. Cl. ..... 252/99; 252/102; 252/524; 252/528; 252/542; 252/547; 252/8.8; 8/115.6

[58] Field of Search ..... 252/547, 542, 528, 524, 252/99, 102, 174.17, 8.8; 8/115.6

[56] References Cited

U.S. PATENT DOCUMENTS

| | | | |
|---|---|---|---|
| 3,580,853 | 5/1971 | Parran | 252/542 X |
| 3,990,991 | 11/1976 | Gerstein | 252/542 |
| 4,061,602 | 12/1977 | Oberstar et al. | 252/547 |
| 4,179,382 | 12/1979 | Rudkin et al. | 8/115.6 X |

*Primary Examiner*—Harris A. Pitlick
*Attorney, Agent, or Firm*—Hammond & Littell, Weissenberger and Muserlian

[57] ABSTRACT

This invention relates to detergent compositions comprising at least one nonionic and/or zwitterionic tenside and from about 0.5 to 10 percent by weight of polysaccharide amino ethers having quaternary ammonium groups. Builder salts and other conventionally used detergent compositions may also be present. These detergent compositions have sizing and stiffening properties and make a secondary treatment of washed textiles unnecessary.

15 Claims, No Drawings

DETERGENT COMPOSITION HAVING A SIZING EFFECT COMPRISING NONIONIC AND/OR ZWITTERIONIC TENSIDES AND POLYSACCHARIDE AMINO ESTERS

FIELD OF THE INVENTION

This invention relates to a detergent composition. More particularly, this invention relates to a detergent composition having a sizing effect.

BACKGROUND OF THE INVENTION

In the textile industry, it is common with regard to the treatment of certain textiles to wash them with a detergent and then, in a separate procedure, to treat the textiles with a sizing or stiffening agent. Such an agent is usually added after the last rinse of the washing process. Applicants have surprisingly found a detergent composition that is effective to clean textiles and to, at the same time, impart a sizing effect.

OBJECTS OF THE INVENTION

It is an object of this invention to provide an improved textile detergent.

It is also an object of this invention to provide a textile detergent that imparts a sizing effect on textiles being washed so that a separate, secondary sizing procedure is unnecessary.

It is further an object of the invention to provide a detergent composition comprised of nonionic and/or zwitterionic tensides, water-soluble polysaccharide amino ethers containing quaternary ammonium groups, and customary detergent additives.

It is yet further an object of the invention to provide a detergent composition comprised of:

(a) from about 1 to 30 percent by weight of nonionic and/or zwitterionic tensides;

(b) from about 0.5 to 10 percent by weight of polysaccharide amino ethers containing quaternary ammonium groups;

(c) from about 0 to 60 percent by weight of builder salts; and (d) remainder customary additives.

These and other objects of the invention will become more apparent in the discussion below.

DESCRIPTION OF THE INVENTION

This invention is directed to textile detergents that impart a sizing effect. The detergent compositions according to the invention are comprised of nonionic and/or zwitterionic surface-active agents, or tensides, and from about 0.5 to 10 percent by weight, based on the weight of the detergent composition, of water-soluble polysaccharide amino ethers containing quaternary ammonium groups.

Especially suitable as polysaccharide amino ethers containing quaternary groups are ethers of polygalactomannan and starch. Polygalactomman is known to be the main constitutent of guar powder and is comprised of trisaccharide units having the following structure.

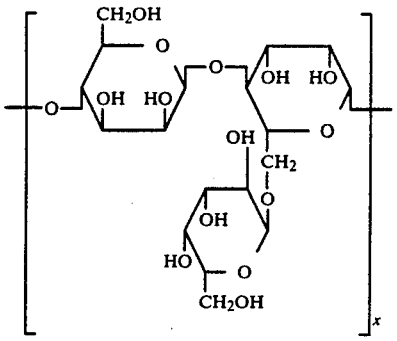

wherein n is a number from about 100 to 1000. The ether groups can form at the —$CH_2OH$ groups, the degree of substitution being in the range of from about 0.05 to 0.2, preferably from about 0.07 to 0.15, ether groups per anhydrogalactomannan unit shown above. The degree of substitution for the starch ethers is from about 0.05 to 0.12, preferably from about 0.07 to 0.1, ether groups per anhydroglucose unit.

The introduction of ether groups into polygalactomannan or starch can take place according to well-known procedures. For example, polygalactomannan or starch may be converted with ethylene imine, as set forth in U.S. Pat. No. 3,303,184, incorporated herein by reference, followed by subsequent partial or complete quaternization of the amino group. The preferred ethers, however, are those that are obtained by, for example, the reaction of polygalactomannan or starch with 2,3-epoxypropyltrialkylammonium salts or 3-chloro-2-hydroxypropyltrimethylammonium salts, especially with 2,3-epoxypropyltrimethylammonium chloride. Such reaction products are described in, for example, British Pat. No. 1,136,842, incorporated herein by reference, and are known as additives in the manufacture of paper or as flocculants.

The quaternary ammonium salts can be present in the form of halides, especially chlorides, sulfates, alkyl sulfates, nitrates, and phosphates and as salts of organic acids, such as, for example, acetates, citrates, or lactates.

The detergent compositions according to the invention preferably contain from about 1 to 5 percent by weight, based on the weight of the total composition, of the polysaccharide amino ethers containing quaternary ammonium groups.

The tenside component preferably consists of nonionic compounds. The content of nonionic tensides in the textile detergent compositions generally amounts to from about 1 to 30 percent by weight, based on the weight of the total composition. The maximum content in powdered to granular detergents is somewhat lower, i.e., it generally does not exceed about 25 percent by weight and is preferably from about 3 to 15 percent by weight.

Suitable nonionic tensides include, in particular, ethoxylation products of alkanols or alkenols having from about 12 to 24, preferably from about 12 to 18, carbon atoms and from about 3 to 20, preferably from about 4 to 15, ethylene glycol ether groups. Suitable alcohols from which the present ethoxylation products can be derived include, for example, those of natural origin, such as alcohols of coconut oil or tallow or oleyl fatty alcohol, or also oxoalcohols of synthetic alcohols obtained by ethylene polymerization.

In addition, suitable nonionic tensides include the ethoxylation products of secondary alkanols and vicinal alkane diols with from about 12 to 18 carbon atoms each and as well as of alkyl phenols with from about 6 to 12 carbon atoms in the alkyl radical, with the number of glycol ether groups also amounting to from about 3 to 20, preferably from about 4 to 15. The above-mentioned ethoxylated alcohols and alkyl phenols may also be replaced completely or partially be compounds prepared by reacting from about 0.5 to 3 mols of propylene oxide per mol of starting compound, i.e., secondary alkanol or alkyl phenol, and then adding the desired amount of ethylene oxide only in the second phase.

If desired, nonionic tensides may also be present that are derived from the above-mentioned compounds and possess the ethylene glycol as well as the propylene glycol ether groups in a different sequence, for example, alcohols with from about 10 to 30 ethylene glycol ether groups and from about 3 to 30 propylene glycol ether groups. Also, ethoxylation products of alkyl mercaptans, fatty acid amides, and fatty acids are useful. Further suitable nonionic tensides include the polyethylene oxide adducts with polypropylene glycol, ethylenediaminepolypropylene glycol and alkylpolypropylene glycol with from about 1 to 10 carbon atoms in the alkyl chain, which are water-soluble and contain from about 20 to 250 ethylene glycol ether groups and from about 10 to 100 propylene glycol ether groups. These compounds usually contain from about 1 to 5 ethylene glycol units per propylene glycol unit. Nonionic aminoxide and sulfoxide compounds, which may also be ethoxylated, if desired, can be used as well.

Usable zwitterionic compounds are those with betaine structure, such as carboxylate betaines, sulfate betaines, and sulfobetaines, containing a straight-chain hydrocarbon radical with from about 12 to 18 carbon atoms. These can be obtained by, for example, the reaction of tertiary amines with halide carboxylic acids, for example, monochloroacetic acid, alkyl halide sulfuric acid esters, alkyl halide sulfonic acids, or alkyl sultones, such as, for example, propanesultone.

The detergent compositions contain at least one nonionic or zwitterionic tenside as well as builder salts that bind calcium ions. They can also contain conventional washing-agent components, such as wash alkalies, neutral salts, soil suspension agents, bleaching agents, enzymes, dyes, and fragrances. Compounds with anionic character that can react with the quaternary polysaccharide esters with the formation of neutral salts that are difficult to dissolve or are insoluble should not be included in the agents used.

Suitable builder salts include the polyphosphates of sodium and potassium. Especially suitable as a polyphosphate is pentasodium triphosphate, which may be present in mixture with its hydrolysis products, the monophosphates and pyrophosphates, as well as phosphates of higher condensation, for example, the tetraphosphates. Further suitable are aluminosilicates of potassium or, especially, sodium that contain water, are capable of cation exchange, and are of the general formula $$(Na_2O)_x \cdot Al_2O_3 \cdot (SiO_2)_y \cdot (H_2O)$$

where x is from about 0.9 to 1.5, y is from about 1.3 to 4.0, and z is from about 1 to 6. These aluminosilicates generally have a granule size of from about 0.1 to 20$\mu$ and are preferably crystalline.

Useful builder salts also include salts of complexing aminopolycarboxylic acids, particularly alkali salts of nitrilotriacetic acid and ethylenediamine-tetraacetic acid, as well as the higher homologues of said aminopolycarboxylic acids. In addition, suitable builder salts include salts of polycarboxylic acids that contain no nitrogen and form complex salts with calcium ions, which group also includes polymers containing carboxyl groups. Examples of such polycarboxylic acids include citric acid, tartaric acid, benzenehexacarboxylic acid, and tetrahydrofuran tetracarboxylic acid. Also suitable are polycarboxylic acids containing carboxymethyl either groups, such as 2,2'-oxydisuccinic acid, as well as polyvalent alcohols or hydroxycarboxylic acids partially or completely etherified with glycolic acid, such as, for example, tricarboxymethylglycerin, bicarboxymethylglycerinic acid, or carboxymethyl oxysuccinic acid.

Complexing salts of polyphosphonic acid, for example, the alkali metal salts of aminopolyphosphonic acids, especially aminotri(methylenephosphonic acid), 1-hydroxyethane-1,1-diphosphonic acid, phenylhydroxymethanediphosphonic acid, methylenediphosphonic acid as well as salts of the higher homologues of the mentioned polyphosphonic acids, or mixtures thereof, may also be present.

The wash alkalies which can be used are the alkali metal carbonates, bicarbonates, borates, and silicates, such as the potassium, and particularly the sodium salts; in the case of the sodium silicates, the ratio $Na_2O:SiO_2$ is between 1:1 and 1:3.5. The amount of wash alkalies is so selected that the pH-value of the wash liquor solution is between about 8.5 and 13, preferably between 9.5 and 11.5. Sodium sulfate and sodium chloride are suitable as neutral salts.

Suitable as soil suspension agents, or greying inhibitors, are compounds of the class of the cellulose ethers, especially nonionic compounds such as methyl cellulose, hydroxyethyl cellulose, methylhydroxyethyl cellulose and methylhydroxypropyl cellulose. Mixtures of the above-mentioned cellulose ethers or mixed ethers can also be used. The soil suspension agents can be present in amounts of from about 0.1 to 5 percent by weight, based on the weight of the total composition.

Bleaching agents can be present, if desired, preferably per-compounds such as perhydrates, examples of which include the alkali metal perborates, percarbonates, perpyrophosphates and persilicates, and urea perhydrate, preference being given to sodium perborate-tetrahydrate. Detergent compositions to be used at low washing temperatures can additionally contain bleach activators, such as tetraacetylethylene diamine or tetraacetyl glycoluril. Also suitable as bleach components are active chlorine compounds, particularly potassium or sodium dichloroisocyanurates; foam inhibitors, especially polydimethylsiloxanes; and proteolytic or amylolytic enzymes. As a protection against premature decomposition, the bleach activators, active chlorine compounds, or enzymes can be embedded in water-soluble or water-dispersible, enveloping substances or in substances melting at anticipated washing temperatures.

The substances may also be present in liquid form and may contain water or organic solvents such as lower alkanols, glycols, glycol ethers, and ether alcohols. Also present may be hydrotropic substances such as the alkali metal salts of the acids of toluene, xylene, ethylbenzene, and cumolsulfonic acid or alkyl sulfates or alkyl sulfonates having from 4 to 8 carbon atoms.

The preparation of powdered or granular textile detergent compositions according to the invention can be carried out in a well-known manner, for example, by granulation or spray-drying. The polysaccharide ethers to be used according to the invention may be added to the slurry for spray-drying.

The textile detergent compositions of this invention are suitable for use in the gentle washing range (from about 20° to 40° C.) and for boiling wash (from about 90° to 98° C.), especially, however, for the care of wash-and-wear textiles in the range of from about 40° to 60° C. They are suitable for the washing of textiles made of cellulose fibers (cotton, linen), of modified cellulose (wash-and-wear finish), as well as of those textiles made of synthetic fibers or for textiles made from a mixture of said fibers.

Powdered to granulated detergent compositions of the invention may have the following general composition:

(a) from about 0.5 to 10, preferably from about 1 to 5, percent by weight of polysaccharide amino ethers containing quaternary ammonium groups;

(b) from about 1 to 30, preferably from about 3 to 15, percent by weight of nonionic tensides, particularly ethoxylated alcohols;

(c) from about 0 to 10, percent by weight of zwitterionic tensides;

(d) from about 10 to 60, preferably from about 25 to 50, percent by weight of builder salts, particularly tripolyphosphate and/or aluminosilicates with calcium-binding capacity;

(e) from about 0 to 25, preferably from about 1 to 15, percent by weight of wash alkalies, particularly sodium silicate and/or sodium carbonate;

(f) from about 0 to 4, preferably from about 0.5 to 2, percent by weight of soil suspension agents, particularly nonionic cellulose ethers;

(g) from about 0 to 30 percent by weight of bleaching agents, as well as a combination thereof with bleach activators and stabilizers, preferably from about 10 to 25 percent by weight of perborate;

(h) from about 0 to 4, preferably from about 0.1 to 2.5, percent by weight of perborate stabilizers, such as magnesium silicate and/or ethylenediamine tetraacetate; and (i) from about 0 to 30 percent by weight of other conventional washing agent components, including sodium sulfate, based on the weight of the total detergent composition.

Liquid textile detergent compositions may have the following composition:

(a) from about 0.5 to 5, preferably from about 1 to 5, percent by weight of polysaccharide amino ethers containing quaternary ammonium groups;

(b) from about 3 to 30, preferably from about 5 to 25, percent by weight of nonionic tensides, particularly ethoxylated alcohols;

(c) from about 0 to 20 percent by weight of water-soluble builder salts, particularly sodium or potassium pyrophosphate or triphosphate;

(d) from about 0 to 2 percent by weight of sequestering agents, particularly Na-ethylenediaminetetraacetate;

(e) from about 2 to 20 percent by weight of organic solvents of the class of alkanols, diols, ether alcohols, and glycol ethers having from 1 to 3 carbon atoms per alcohol moiety;

(f) from about 0 to 1 percent of dyes, fragrances, and preservatives, and other conventional additives; and (g) the remainder water, based on the weight of the total detergent composition.

The textile detergents according to the invention are characterized by their good washing action and also by valuable sizing and stiffening properties. This is reflected in a greater bending stiffness and an improved surface smoothness of the washed textiles. These effects are known as such as consequences of sizing, however, a secondary treatment that increased the use of water and required more time was always necessary for this purpose. The use of the substances according to the invention results in a simplification of the washing process and in the conservation of water and energy.

The following examples are intended to illustrate the invention and are not to be construed as limiting the invention thereto.

EXAMPLES 1-3

Detergents having the following composition were prepared:

4.5 percent by weight of polysaccharide amino ether
5.0 percent by weight of ethoxylated tallow fatty alcohol (14 EO, i.e., the degree of ethoxylation was 14)
3.0 percent by weight of ethoxylated tallow fatty alcohol (5 EO)
40.0 percent by weight of Na-triphosphate
6.5 percent by weight of sodium carbonate
4.5 percent by weight of sodium silicate ($Na_2O:SiO_2=3.3:1$)
0.2 percent by weight of Na-ethylenediaminetetraacetate
0.2 percent by weight of proteolytic enzyme
26.6 percent by weight of sodium sulfate
9.5 percent by weight of water The polysaccharide amino ethers employed were as follows:

A—polygalactomannan amino ether prepared by reaction of guar powder with 2,3-epoxypropyltrimethylammonium chloride, degree of substitution=0.1 quaternary ether groups per anhydrogalactomannan unit;

B—polygalactomannan amino ether, prepared in the same manner as product A, degree of substitution=0.15 quaternary ether groups per anhydrogalactomannan unit; and C—starch amino ether, prepared by the reaction of starch with 2,3-epoxypropyltrimethylammonium chloride, degree of substitution=0.085 quaternary ether groups per anhydroglucose unit.

For comparison, the polysaccharide amino ether component was replaced by sodium sulfate.

The detergent compositions were then tested. Curtain-binding and unbleached cotton material were used as textile material. Washing was carried out in an automatic washing machine with a horizontal drum at 40° C. (wash and wear cycle). In each test run the detergent concentration was 8.4 gm/1, the bath ratio (kg of wash per liter of washing solution) was 1:20, the water hardness was 16° dH, and the washing time was 20 minutes. After the removal of the washing solution, the wash was rinsed three times with water and dried. After one and three wash cycles (abbreviated "1W" and "3W"), the curtain-binding was tested for changes in tensile resistance and the cotton material was tested for resistance to bending and for sliding friction or adhesive friction. An increase in tensile resistance or resistance to bending corresponds to an increase in usage value; a decrease in adhesive friction or sliding friction corresponds to a desirable improvement of surface smoothness. The test results are set forth in the following table:

TABLE

| Example | Additive | Tensile Resistance (cN) | | Resistance to Bending (10 cN . m) | | Adhesive Friction (cN) | | Sliding Friction (cN) | |
|---|---|---|---|---|---|---|---|---|---|
| | | 1 W | 3 W | 1 W | 3 W | 1 W | 3 W | 1 W | 3 W |
| 1 | A | 456 | 787 | 0,70 | 0,74 | 445 | 458 | 388 | 400 |
| 2 | B | 462 | 649 | 0,73 | 1,17 | 439 | 432 | 377 | 345 |
| 3 | C | 447 | 501 | 0,62 | 0,85 | 457 | 449 | 364 | 369 |
| Comparison | — | 326 | 342 | 0,59 | 0,53 | 469 | 499 | 402 | 415 |

As can be seen from the table, the textiles treated with detergent compositions according to the invention exhibited improved properties. In addition, a pronounced decrease in surface friction or adhesive friction could be observed with regard to diapers of modified cotton that were washed in the same manner at a temperature of 60° C.

The preceding specific embodiments are illustrative of the practice of the invention. It is to be understood however, that other expedients known to those skilled in the art or disclosed herein, may be employed without departing from the spirit of the invention or the scope of the appended claims.

We claim:

1. A detergent composition with a sizing effect, which is liquid and which comprises:

(a) from about 0.5 to 5 percent by weight of polysaccharide amino ether containing quaternary ammonium groups;

(b) from about 3 to 30 percent by weight of nonionic tenside;

(c) from about 0 to 20 percent by weight of water-soluble builder salt;

(d) from about 0 to 2 percent by weight of sequestering agent;

(e) from about 2 to 20 percent by weight of an organic solvent selected from the group consisting of alkanols, diols, ether alcohols, glycol ethers having from 1 to 3 carbon atoms per alcohol moiety, and mixtures thereof;

(f) from about 0 to 1 percent of dyes, fragrances, and preservatives; and (g) the remainder water, based on the weight of the total detergent composition.

2. The detergent composition of claim 1 wherein component (a) comprises polygalactomannan amino ethers containing quaternary ammonium groups with a degree of substitution of from about 0.05 to 0.2 ether groups per anhydrogalactomannan unit.

3. The detergent composition of claim 1 wherein component (a) comprises starch amino ethers containing quaternary ammonium groups with a degree of substitution of from about 0.05 to 0.12 ether groups per anhydroglucose unit.

4. The detergent composition of claim 1 wherein component (a) comprises ethers obtained by reacting polygalactomannan and/or starch with 2,3-epoxypropyltrimethylammonium salts.

5. The detergent composition of claim 1 which comprises from about 1 to 5 percent by weight of component (a).

6. The detergent composition of claim 1 wherein the builder salt is sodium or potassium pyrophosphate or triphosphate.

7. A detergent compositon with a sizing effect, which is a powder and which comprises:

(a) from about 0.5 to 10 percent by weight of polysaccharide amino ether containing quaternary ammonium groups;

(b) from about 1 to 30 percent by weight of nonionic tenside;

(c) from about 0 to 10 percent by weight of zwitterionic tenside;

(d) from about 10 to 60 percent by weight of builder salt;

(e) from about 0 to 25 percent by weight of wash alkali;

(f) from about 0 to 4 percent by weight of soil suspension agent;

(g) from about 0 to 30 percent by weight of bleaching agent, as well as a combination thereof with bleach activator and stabilizer; and (h) from about 0 to 30 percent by weight of other conventional washing agent components;

based on the weight of the total detergent composition.

8. The detergent composition of claim 7 wherein component (a) comprises polygalactomannan amino ethers containing quaternary ammonium groups with a degree of substitution of from about 0.05 to 0.2 ether groups per anhydrogalactomannan unit.

9. The detergent composition of claim 7 wherein component (a) comprises starch amino ethers containing quaternary ammonium groups with a degree of substitution of from about 0.05 to 0.12 ether groups per anhydroglucose unit.

10. The detergent composition of claim 7 wherein component (a) comprises ethers obtained by reacting polygalactomannan and/or starch with 2,3-epoxypropyltrimethylammonium salts.

11. The detergent composition of claim 7 which comprises from about 1 to 5 percent by weight of component (a).

12. The detergent composition of claim 7 which comprises a total of from about 1 to 30 percent by weight of components (b) and (c).

13. The detergent composition of claim 7 wherein the builder salt is sodium or potassium pyrophosphate or triphosphate.

14. The detergent composition of claim 7 which comprises from about 10 to 25 percent by weight of perboate as bleaching agent and from about 0.1 to 2.5 percent by weight of magnesium silicate and/or ethylenediamine tetraacetate as perborate stabilizer.

15. A detergent composition with a sizing effect which consists essentially of:

(a) from about 1 to 30 percent by weight of nonionic and/or zwitterionic tenside;

(b) from about 0.5 to 10 percent by weight of polysaccharide amino ether containing quaternary ammonium groups;

(c) from about 0 to 60 percent by weight of builder salt; and (d) the ramainder customary additives.

* * * * *

UNITED STATES PATENT AND TRADEMARK OFFICE

CERTIFICATE OF CORRECTION

PATENT NO. : 4,289,642

DATED : September 15, 1981

INVENTOR(S) : RUDOLF WEBER et al.

It is certified that error appears in the above—identified patent and that said Letters Patent is hereby corrected as shown below:

Preamble page, item [75], should read:

-- Rudolf Weber, Düsseldorf; Hans Andree, Leichlinger; and Gertrud Wetzel, Erkrath, all of Fed. Rep. of Germany --.

Column 8, lines 49-50, "sodium or potassium pyrophosphate or triphosphate" should read -- pentasodium triphosphate or sodium aluminosilicate with calcium-binding capacity --.

Column 8, line 52, "perbo-" should read -- perbor --.

Signed and Sealed this

*Thirteenth* Day of *April 1982*

[SEAL]

*Attest:*

GERALD J. MOSSINGHOFF

*Attesting Officer*

*Commissioner of Patents and Trademarks*